United States Patent [19]

Ladet et al.

[11] 4,360,411

[45] Nov. 23, 1982

[54] ALUMINUM ELECTRICAL CONTACTS AND METHOD OF MAKING SAME

[75] Inventors: Michel Ladet, Grenoble; Jacques Lefevre, Voiron; Jos Patrie, Grenoble, all of France

[73] Assignee: Societe de Vente de l'Aluminium Pechiney, Paris, France

[21] Appl. No.: 179,434

[22] Filed: Aug. 19, 1980

Related U.S. Application Data

[62] Division of Ser. No. 25,488, Mar. 30, 1979, abandoned.

[30] Foreign Application Priority Data

Mar. 31, 1978 [FR] France ..... 78 10333

[51] Int. Cl.[3] ..... C25D 5/44

[52] U.S. Cl. ..... 204/33; 200/263; 204/38 B

[58] Field of Search ..... 204/33, 38 B; 427/438

[56] References Cited

U.S. PATENT DOCUMENTS 2,746,136 5/1956 Richaud ..... 204/33 X
3,324,269 6/1967 LaRoy ..... 200/268
4,122,215 10/1978 Vratny ..... 427/92

FOREIGN PATENT DOCUMENTS 438228 11/1935 United Kingdom ..... 204/33
593762 10/1947 United Kingdom ..... 204/33

OTHER PUBLICATIONS

F. A. Lowenheim, *Electroplating*, McGraw-Hill Book Co., New York, 1978, pp. 389-391.

Metal Finishing Guidebook and Directory for 1978, Metals and Plastics Publications, Hackensack, N.J., p. 286.

*Primary Examiner*—Winston A. Douglas
*Assistant Examiner*—William Leader
*Attorney, Agent, or Firm*—Dennison, Meserole, Pollack & Scheiner

[57] ABSTRACT

The invention relates to elements of aluminium, such as bars, sections or apparatus components for forming electrical contacts capable of withstanding mechanical and thermal stressing. The method by which these elements are produced consists in depositing a firmly adhering layer of nickel to the aluminium substrate at least in the contact zone. The quality of the contact is further improved when the nickel-plated element is in contact with a silver-plated element. The elements according to the invention may be used for the production of pin-type contacts and any other devices for making or breaking electrical circuits, such as isolators, circuit breakers, and contactors.

4 Claims, 7 Drawing Figures

ALUMINUM ELECTRICAL CONTACTS AND METHOD OF MAKING SAME

This is a division of the application Ser. No. 25,488, filed Mar. 30, 1979, now abandoned.

The new method of the invention is applicable to the production of fixed or moving electrical contacts on all kinds of aluminum products such as bars, sections of all kinds or apparatus components.

This new method is intended inter alia for the production of contacts subjected to severe mechanical and thermal stressing, such as contacts of the type formed by pinning and unpinning fingers to and from line bars. The invention may also be used for the production of sliding-contact systems of the type used in rotating electrical machines with collectors or rings. Finally, the invention may also be used for the production of circuit breakers, contactors, cutouts or isolators.

The considerable development of aluminum as an electrical conductor is well known. It has superceded copper in a large number of applications, primarily by virtue of its considerably lower cost. However, in the majority of applications where contact problems have to be solved, copper retains a technical advantage because it can be soldered and used for the production of contacts of low electrical resistance by mechanical clamping without any particular surface preparation.

In order to improve the contact characteristics of conductive aluminum, it is known that it may be coated with a layer of tin from 4 to 20$\mu$ thick deposited on a layer of zinc or bronze.

Thus, sets of line bars of tin-coated aluminum have been developed as a replacement for similar bars of copper for the equipment of electricity supply networks in factories or in the risers of large buildings. The required connections between these sets of bars and the various loads are established by means of fixed or removable devices, for example by means of removable contact fingers which are connected to the line bars. The bars thus coated with tin are made of conductive aluminum generally containing at least 99.5% of aluminum, such as A5 (AFNOR standard), or of various aluminum alloys used as conductors, such as AGS/L (AFNOR standard), which is particularly suitable for moldings. The contact fingers are generally made of copper or copper-based alloys, such as for example brasses or bronzes.

In the case of devices comprising removable contacts, experience has shown that these installations, of which considerable robustness is expected, undergo rapid deterioration attributable essentially to the degradation in the quality of the contacts between the bars of tin-plated aluminum and the contact fingers. This degradation, which occurs more or less rapidly according to the characteristics of the contact elements and the intensity of the current which passes through them, is reflected in a progressive increase in the resistance of the contact which gives rise to heating. This heating causes or accelerates oxidation processes and the contacts gradually become seriously damaged which may result in failures and production losses.

By using fingers of pure or tin-plated copper in contact with sets of tin-plated aluminum bars, the first incidents arising out of poor contacts often occur after only six months' to one year's use.

In the course of research work carried out with a view to finding a solution to these problems of electrical contact on aluminum, it was found that one of the essential factors in the process of degradation of these contacts is the wear of the surface layers on the surfaces in contact with one another which is caused by an alternating vibratory movement of mechanical or electrical origin in conjunction with the frequency of the current. This vibratory movement, which arises out of interactions between field and alternating current, produces a kind of fretting corrosion which results in the surface abrasion of the coating layers of the conductors and, in particular, of the layer of tin protecting the aluminum. It is easy to understand that the at least partial elimination of the coating results in oxidation of the underlying metal which in turn promotes heating of the contact zone which thus oxidizes more quickly. Once a process such as this has started, the total destruction of the contact is likely to occur more or less rapidly. By virtue of the new method according to the present invention, it is possible to produce electrical contacts on aluminum components of which the service life under conditions of severe mechanical and thermal stressing is considerably increased. In the context of the present invention, aluminum components are understood to be any components of non-alloyed aluminum used as conductors, such as components of A5 or other grades of non-alloyed aluminum and also any components of aluminum-based alloys used as conductors, such as components of AGS/L or even AS7G.

This invention also relates to new electrical contact devices of the pressure type which enable electrical circuits to be made and/or maintained and/or broken, these new devices having an increased resistance to mechanical and/or thermal stressing and, hence, much greater stability as a function of time.

The new method for producing electrical contacts is characterised in that the aluminum component(s) is coated, at least in the contact zone, with a firmly adhering layer of nickel deposited directly onto the aluminum substrate.

The particular adhesion characteristics of the nickel deposit formed without an intermediate layer emanate from the surface preparation of the aluminum components before coating. As will be seen, this surface preparation provides both for the complete elimination of the oxidized layer and for the formation of a surface having a particular appearance, observable through an electron microscope, which promotes the coupling of the nickel deposit.

It is possible further to improve the quality of the electrical contact by bringing the nickel-coated aluminum component into contact with a silver-coated component of which the core consists of aluminum or copper. In the context of the invention, aluminum, nickel, silver or copper are understood to be the corresponding metals in their non-alloyed state with the usual impurities, of which the level may vary according to the particular applications envisaged, and also alloys based on aluminum, nickel, silver or copper which are capable of being used as electrical conductors.

As tests have shown, the remarkable quality of the contact devices according to the invention is attributable above all to the effectiveness of the layer of nickel which protects the aluminum and also to the particular properties of the nickel/silver contact couple. It will be seen that other metals may be used instead of silver, but at the expense of considerably reduced performance levels.

One of the main difficulties which had to be overcome in arriving at the devices according to the invention was the direct formation of a nickel coating on the aluminum contacts in the absence of any intermediate layer.

It was in fact found that, to obtain high thermal stability, it was necessary to dispense with the deposition of intermediate layers of metals such as tin, zinc, copper or bronze, which tend to diffuse into the underlying metal, often with formation of embrittling intermetallic compounds. Finally, it is desirable to use an electrodeposition process using stable baths with as simple a composition as possible to enable the contacts to be coated under the most favorable conditions from the point of view of cost.

The process for the direct electrodeposition of nickel, to which the present invention also relates, comprises an initial step in which a temporary predeposit of nickel is formed by means of a bath of predetermined composition in the absence of electrical current. This predeposit is then eliminated, after which the definitive coating layer of nickel is electrolytically deposited. Examinations under a microscope during the various stages of this treatment have shown that, by combining a chemically formed predeposit of nickel with the redissolution of this deposit, it is possible to obtain a surface which is both completely free from oxidation and has a particular appearance and which therefore forms an extremely effective coupling base for the subsequent definitive deposit of nickel.

As will be seen hereinafter, the coating of nickel obtained by the process thus perfected shows exceptional adhesion at low and high temperatures which enables particularly durable contact elements to be produced. This is because nickel has the advantage of high thermal stability over the other metals used for coating aluminum, such as copper, zinc or tin. Thus, the diffusion of nickel into aluminum is negligible and harmless, even at temperatures where tin and zinc have already melted. Nickel also has the advantage of being a far less rare and, hence, expensive metal than tin of which the price is not subject to speculative variations to the same extent as tin or copper.

This direct nickel-plating operation may be carried out either continuously or in batches on components which will be subsequently used for the production of contacts of all kinds. It comprises the following steps:

the components to be coated are subjected, if necessary after pickling, to predeposition in the absence of current in a fluoboric bath containing nickel. The bath is formed by an aqueous solution containing:

HF: 5 to 50 g/l
$H_3BO_3$: 10 to 60 g/l
$NiCl_2.6H_2O$: 50 to 500 g/l.

The temperature is preferably in the range from 20° to 50° C. The residence time in the bath is very short, amounting to between a few seconds and a few tens of seconds.

The very thin deposit of nickel thus formed is then redissolved, for example in a nitric acid/hydrofluoric acid bath containing:

HF: 5 to 20 g/l
$HNO_3$: 200 to 500 g/l.

The residence time in this bath amounts to a few minutes at a temperature in the range from 20° to 50° C.

The components thus prepared are then nickel-plated by a known electrolytic method. It is possible for example to use a nickel-plating bath containing:

$NiCl_2$: 30 g/l
Ni-sulphamate: 300 g/l
$H_3BO_3$: 30 g/l.

The current density amounts to between 2 and 20 A/dm$^2$.

The thickness of the nickel layer is determined by the applications envisaged. In general, it amounts to between about 3 and about 25 μm. Other baths may also be used. In particular, it is possible to use baths enabling nickel-based alloys to be deposited.

EXAMPLE

Sections of aluminium alloy (AGS/L) bars measuring 40×6 mm intended for the production of pin-type sliding contacts were coated with nickel.

The following procedure was adopted:

(1) Alkaline degreasing with an aqueous solution of 15 g/l of DIVERSEY 708 (a Trade Mark of DIVERSEY, a French Company) at a temperature of 60° C.; treatment time 5 minutes.

(2) Alkaline pickling with an aqueous solution of 50 g/l of Aluminux (a Trade Mark of DIVERSEY, a French Company) at a temperature of 50° C.; treatment time: 5 minutes.

(3) Neutralization with hydrofluoric/nitric acid ($HNO_3$: 400 g/l; HF: 15 g/l), treatment time: 30 seconds.

(4) Predeposit of nickel in the absence of electrical current using an aqueous solution containing:

HF: 10 g/l
$H_3BO_3$: 40 g/l
$NiCl_2.6H_2O$: 400 g/l.

The residence time was 15 seconds at 30° C.

(5) Dissolution of the nickel deposit in a hydrofluoric/nitric acid bath containing $HNO_3$: 400 g/l
HF: 15 g/l.

Treatment time 3 minutes at approximately 20° C.

(6) Electrolytic nickel plating using an aqueous solution containing:

nickel-sulphamate: 300 g/l
$H_3BO_3$: 30 g/l
$NiCl_2$: 30 g/l.

Electrolysis is carried out between nickel anodes and the bars to be coated over a period of 25 minutes at 40° C. with a current density of 3 A/dm$^2$. The nickel layer obtained has a thickness of approximately 15 microns.

The quality of pin-type contacts between these bars and contact fingers comprising different coatings was then compared with that of contacts formed between identical bars coated with tin and similar contact fingers. The quality of the contacts was assessed by a so-called fretting corrosion test in which the surfaces in contact with one another are subjected under pressure to alternating "microsliding" movements which, to a certain extent, reproduce what happens in reality under the action of the forces arising out of the field/alternating current interactions, in most cases at frequencies amounting to twice the base frequency of this current.

The accompanying drawings illustrate the conditions under which the test is carried out:

Figure 1:
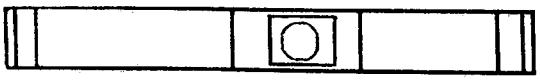
FIG. 1 is an elevation of a contact finger.
Figure 2:
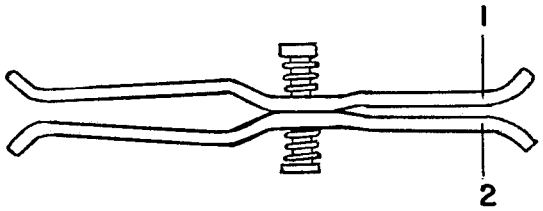
FIG. 2 is a plan view of a contact finger.
Figure 3:
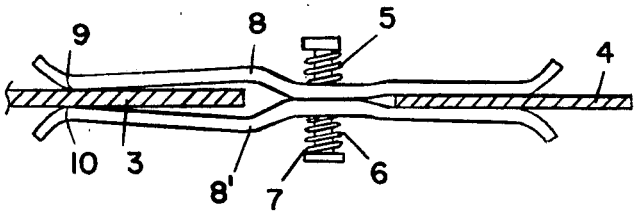
FIG. 3 is a view of a contact finger fixed to a supporting strip and pinned to a bar.
Figure 4:
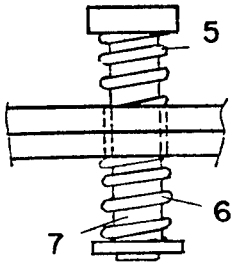
FIG. 4 shows a central detail of FIG. 3.
Figure 5:
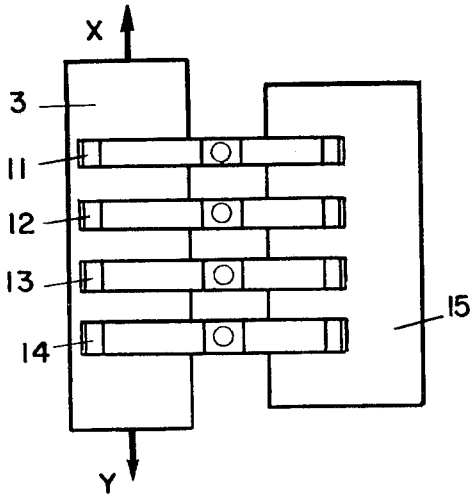

FIG. 5 diagrammatically illustrates the test apparatus.

FIG. 6 diagrammatically illustrates an apparatus for measuring the contact resistance between the coating and the substrate, and FIG. 7 is a section through part of FIG. 6, taken along the section line.

FIGS. 1 to 4 show one embodiment of a contact finger. It can be seen that the contact finger consists of two elastic strips (1) and (2), generally known as tongues, of copper or a copper-based alloy measuring approximately 10×2 mm which are formed in such a way that they are able elastically to grip a contact bar (3) measuring approximately 40×6 mm. The contact between the finger and the load circuit is obtained in the same way by gripping a strip (4) connected to this circuit. Springs (5) and (6) mounted on the shaft (7) hold the assembly together under a pressure of approximately 1 kg. The curvature of the tongues in the zones (8) and (8') is such that, in practice, the contact between the bars and tongues is confined to the ends thereof at (9) and (10).

FIG. 5 diagrammatically illustrates the test apparatus. The aluminum bar (3) measuring 40×6 mm is fixed at its two ends in the jaws of an alternate traction/compression machine (not shown). In this way, the bar is subjected to alternating forces along the axis XY at a frequency of 155 c/s. These forces are reflected at the level of the contacts in alternating "microsliding" movements comparable with those occurring in electrical installations.

Four fingers identical with that shown in FIGS. 1 to 4, denoted by the reference numerals (11, 12, 13 and 14), are fixed at one end to a stationary part (15) integral with a base (not shown).

The traction/compression stress applied to the bar amounts to ±80 MPa.

Each test carried out consists in subjecting each finger/bar contact to 200,000 traction/compression cycles.

Ten different couples were tested.

The first five couples which correspond to the methods normally adopted for the production of pin-type contacts involve contacts comprising a bar of AGS/L electrolytically coated with a 17 μm thick layer of tin on a bronze substrate. The copper fingers are either uncoated or coated with tin or nickel or a tin-nickel alloy or with silver.

The five other couples which correspond to the method according to the invention comprise a bar of AGS/L coated with a 15 μm thick layer of nickel in the manner described in the Example and a second series of five copper fingers identical with the first series.

Each of the ten couples thus defined was tested four times, i.e. four identical fingers in contact with sections of AGS/L bars coated either with nickel or with tin were used for each couple and the value of the result was determined by measuring the size of the oxidation patches formed on the surface of the bars after 200,000 cycles.

The results obtained are set out in Table I below:

TABLE I

| Coating of the copper finger | Mean size of the oxidation patch after testing in mm² | |
|---|---|---|
| | AGS/L bar coated with tin | AGS/L bar coated with nickel |
| tin | 52 | 50 |
| copper, uncoated | 48 | 33 |
| nickel | 66 | 26 |

TABLE I-continued

| Coating of the copper finger | Mean size of the oxidation patch after testing in mm² | |
|---|---|---|
| | AGS/L bar coated with tin | AGS/L bar coated with nickel |
| tin-nickel | 34 | 14 |
| silver | 23 | 7 |

These results show first of all that the tin coating shows poor resistance to fretting corrosion. Accordingly, they show that, for each group of two couples comprising a similar finger, it is always that couple which comprises the nickel-plated bar which gives the better result. Finally, the association of a silver-coated finger with a nickel-plated bar of AGS/L gives a particularly remarkable and entirely unexpected result.

Additional tests were carried out to evaluate the quality of the nickel coatings applied in accordance with the invention.

First of all, a study was made of the influence of ageing at 200° C. on the electrical contact resistance between the layer of nickel and the substrate. To this end, sections of an AGS/L bar measuring 40×6 mm coated in the manner described in the Example with a 15 μm thick layer of nickel were coated with an additional 3 μm layer of silver applied in known manner by electrolysis in a cyanide bath.

The apparatus used for measuring the contact resistance is illustrated in FIGS. 6 and 7.

Two fingers (16) and (17) of copper identical in their dimensions with those described at the beginning of the Example and illustrated in FIGS. 1 to 4 are pinned to a section of an AGS/L bar (18) measuring 40×6 mm coated in the manner just described with nickel (15 μm) and silver (3 μm). Each of these fingers is pinned at its other end to contact bars (19) and (20) which are connected to a source of direct current.

Contact between the ends of each of the tongues, such as (21) and (22), and the bar (18) is ensured by means of silver contact pellets (23) and (24) of which the flat and parallel contact faces are in the form of a square measuring 3×3 mm. One of the faces of each of these pellets is brazed to the tongue, while the other rests on the surface of the bar. The thickness of these pellets is approximately 1 mm and the clamping pressure of the tongues of the order of 1 kgf enables firm contact to be established between each pellet and the silver-coated surface of the bar on which it rests.

The distance D between the fingers (16) and (17) FIG. 6 at the level of their contact with the bar (18) via the silver pellets amounts to 50 mm (between axes).

A recording voltmeter (V) is connected to the ends of the tongues at the level of the contact pellets. It enables the trend of the voltage to be measured as a function of time. The intensity of the direct current is fixed at a constant value of 25 amperes. Accordingly, it can be seen that, from a simple measurement of voltage, it is possible to deduce a global electrical resistance "R" which is the sum of the contact resistances between the two fingers and the bar plus the resistances encountered by the current flowing through the section of bar between the two fingers. The contact resistance between the silver layer and the nickel layer is negligible. Calibration tests have shown that, by carefully adjusting the contacts between the silver pellets and the silver-coated surface of the bar, the initial value of R is only slightly greater than the sum of the two contact resistances between the nickel layer and the substrate which are in series. Accordingly, the development of R as a function of time is reflected in a corresponding development of this contact resistance. This development was studied in a test lasting 1000 hours during which the described arrangement was kept enclosed in a dry-air atmosphere at a temperature of 200° C.

The following results are each the average of ten different tests:

initial resistance: 0.12 m Ω
resistance after 250 h at 200° C.: 0.25 m Ω
resistance after 500 h at 200° C.: 0.31 m Ω
resistance after 1000 h at 200° C.: 0.27 m Ω.

It can be seen that, after a slight initial increase, the contact resistance remains virtually stable as a function of time. By comparison, coatings of tin on aluminum show poor resistance to exposure for a few hundred hours to temperatures of 200° C., signs of the tin having diffused into the intermediate sub-layer and then into the underlying aluminum rapidly appearing.

90° bending tests were carried out on sections of 40×6 mm AGS/L bars coated with 15 μm of nickel in accordance with ASTM B 571 before and after ageing for 1000 hours at 200° C. The layer of nickel did not show any signs of separation in the bending zone. Bending through 180° did not produce any separation either.

Other sections of the same bars were exposed to a salt mist for periods of 100 to 400 hours in accordance with NF 41002. The layer of nickel did not show any signs of separation during these tests.

AGS/L plates measuring 64×72×2 mm were also coated with a 15 μm thick layer of nickel by the method described in the Example. These plates were then locally heated for 6 to 7 minutes to a temperature approaching the melting point of aluminum, the arrangement being such that the aluminum began to melt over an area of 1 or 2 square centimeters on each plate. After cooling, it was found that the layer of nickel had retained all its properties of adhesion.

Finally, the bars thus coated with nickel are capable of being brazed at relatively high temperatures without separation of the layer of nickel. Thus, it is possible to join AGS/L bars coated with nickel by the method described in the Example by brazing with a Cd/Ag-alloy containing 95% of Cd and 5% of Ag. This brazing alloy has a melting point of from 340° to 395° C. It is also possible with the same alloy to braze AGS/L bars coated with nickel by the method described in the Example to other metals, such as copper, silver or copper or silver alloys using conventional fluxes for brazing of this type. This demonstrates the considerable advantage of this nickel coating over conventional coatings based on tin which can only be soldered using tin or tin-lead with relatively poor mechanical properties.

For certain particular applications, it is possible, with a view to further improving the quality of the contacts, to deposit a thin layer of silver on the layer of nickel which, according to the invention, covers an aluminum substrate. A deposit such as this may be obtained for example by electrolysis in a silver cyanide bath, as mentioned above.

Tests were carried out to study the resistance to abrasion of electrical contacts of which one of the two contact elements is made of aluminum coated with nickel and then silver, the other element being a copper finger comprising silver contact pellets brazed to the ends of the tongues identical with that illustrated in FIG. 7. As in the case which has just been described, this finger is pinned to a section of a 40×6 mm AGS/L bar coated with 15 μm of nickel and then with 3 μm of silver in the manner previously described. Using a known apparatus, it is possible to subject the section to alternate movements in its plane with an amplitude of approximately 6 mm at a frequency of 3600 cycles/h, the finger and hence the silver contact pellets remaining fixed. The contact surface of these pellets with the bar is the same as in the preceding Example, i.e. 9 $mm^2$ in each case. The force by which the two tongues are braced against one another is also the same, i.e. 1 kgf.

A stabilised current source of known type connected on the one hand to the finger and on the other hand to the bar section delivers a constant alternating current of 250 A which traverses the contact between the bar and the finger. This current increases the temperature of the bar by about 75° C. above ambient temperature (i.e. approximately 100° C. for an ambient temperature of 25° C.).

The contacts were subjected to a series of wear tests. During each of these tests, the bar/finger contact was subjected to 15–20,000 cycles.

The resulting wear of the contacts was measured both from the weight loss and from the variation in voltage drop.

Table II below shows the total weight losses in mmg resulting from the wear of the contacts between the bar and the finger. The voltage drop at the level of these contacts is also given. It was measured between the end of the tongues at the level of the contact pellets and the bar in the immediate vicinity of the contact zone.

These results reflect the minimal wear of the contacts despite severe friction conditions and a reduction in the contact voltage drops due possibly to a kind of polishing of the contact surfaces.

Accordingly, this deposit of silver enables the remarkable qualities of a firmly adhering layer of nickel deposited directly on an aluminum substrate to be combined with the well known qualities of silver for the production of electrical contacts.

TABLE II

| Number of cycles applied | Total weight loss of the contact zones in mg | Voltage drop between silver contact pellets and the bar at the level of the contacts with the element (25) in $10^{-3}$ V |
|---|---|---|
| 0 | 0 | 34 to 37 |
| 5000 | 4.5 | 28 to 35 |
| 10000 | 13 | 25 to 30 |
| 15000 | 22 | 21 to 25 |
| 20000 | — | 21 to 22 |

It can be seen that, by virtue of the new method according to the invention, it is possible to produce contact devices which have remarkable characteristics of resistance to mechanical and thermal stressing which makes them suitable for use under the most rigorous working conditions.

These contact devices may be modified in numerous ways without departing from the scope of the invention.

In particular, it is possible for certain applications to produce devices of which the two contact elements consist of aluminum coated with nickel by the method according to the invention. It is also possible to coat at least one of the aluminum contact elements with a layer of silver deposited on a layer of nickel.

It is also possible by means of the devices according to the invention to produce all kinds of devices for making or breaking electrical connections and, in particular, collectors and circuit breakers for domestic or professional use and also certain types of contactors or isolators.

It is also possible to produce conductors of considerable length coated with nickel from one end to the other for forming static contacts at any point.

Finally, it is possible in accordance with the invention to produce devices comprising contact elements of nickel-plated aluminum to which is brazed a contact plate of copper or silver or a contact alloy or pseudo-alloy resistant to the impact of brief electrical arcs and also to abrasion. Devices such as these may be used for making and breaking circuits and also for sliding contacts of the type formed on collectors and rings.

We claim:

1. A method of producing electrical contacts comprising electrolytically coating conductive elements of aluminum with nickel and wherein an initial thin layer of nickel is deposited by chemical displacement in an acidic aqueous bath comprising:

HF: 5 to 50 g/l $H_3BO_3$: 10 to 60 g/l $NiCl_2.6H_2O$: 50 to 500 g/l and then said initial layer of nickel is dissolved in an acid solution to produce an oxide-free surface before the definitive layer of nickel is electrolytically deposited directly onto the aluminum conductive elements.

2. A method as claimed in claim 1 wherein the elements to be coated are pickled before the initial deposit is applied.

3. A method as claimed in claim 1 wherein the definitive protective layer is formed by electrolytic deposition from a bath containing nickel sulphamate, boric acid and nickel chloride.

4. A method for the production of a nickel plated aluminum substrate electrical contact member by electrodeposition of a nickel electrical contact layer directly on a surface of an aluminum substrate by the sequential manipulative steps of:

(a) preparing the surface of the aluminum substrate by;

(i) depositing a thin layer of nickel on the surface of the substrate by chemical displacement in an acidic aqueous solution comprising.

HF: 5 to 50 g/l $H_3BO_3$: 10 to 60 g/l $NiCl_2.6H_2O$: 50 to 500 g/l (ii) removing the thin layer of nickel by dissolution wherein the surface of the substrate contiguous with the removed nickel is physically modified and oxide-free; and (b) electrodepositioning a nickel electrical contact layer on the prepared surface of the aluminum substrate whereby resistance to mechanical and or thermal stressing of the nickel contact layer-aluminum substrate bond is increased.

* * * * *